US006520709B1

(12) United States Patent
Mosing et al.

(10) Patent No.: US 6,520,709 B1
(45) Date of Patent: Feb. 18, 2003

(54) VARIABLE LENGTH/CAPACITY ELEVATOR LINKS

(75) Inventors: Donald E. Mosing, Lafayette, LA (US); Mark S. Sibille, Lafayette, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 0 days.

(21) Appl. No.: 09/557,940

(22) Filed: Apr. 24, 2000

Related U.S. Application Data

(60) Provisional application No. 60/131,998, filed on Apr. 30, 1999.

(51) Int. Cl.[7] ..... B21L 17/00

(52) U.S. Cl. ..... 403/305; 403/300; 403/308; 59/78

(58) Field of Search ..... 403/305, 303, 403/300, 301, 302, 306, 308, 79; 59/78, 84

(56) References Cited

U.S. PATENT DOCUMENTS

| | | | | |
|---|---|---|---|---|
| 3,777,046 A | * | 12/1973 | Schiavone | 403/300 X |
| 3,996,737 A | * | 12/1976 | Burstall | 59/78 X |
| 4,421,447 A | * | 12/1983 | Gudgel et al. | 414/22 |
| 5,529,316 A | * | 6/1996 | Mattila | 280/95.1 |
| 5,906,450 A | * | 5/1999 | Ng | 403/46 |

* cited by examiner

*Primary Examiner*—Lynne H. Browne
*Assistant Examiner*—John R. Cottingham
(74) *Attorney, Agent, or Firm*—The Matthews Firm

(57) ABSTRACT

Multi-piece elevator links, which may be of variable length or capacity or both, are produced by cutting a unitary link into two parts and connecting different combinations of shanks and link ends to form the desired elevator link. Rotation of the link ends with respect to the shank may be prevented. Adapters may be employed between the shank and the link ends to provide varying connections.

22 Claims, 5 Drawing Sheets

VARIABLE LENGTH/CAPACITY ELEVATOR LINKS

RELATED APPLICATIONS

The present invention claims priority from U.S. of America Provisional Patent Application 60/131,998 filed Apr. 30, 1999 for "Variable Length/Capacity Elevator Links".

TECHNICAL FIELD

The present invention relates generally to elevator links (bails) and more particularly to a method and apparatus for varying the length of elevator links composed of multi-piece sections which provide for adjustable lengths and tonnage capacities, and for interchangeable link ends and adapters, and for such other structures and methods as may be herein disclosed.

BACKGROUND ART

In general, elevator links (also known as bails) are attached between the elevator and the traveling block of a drilling rig. The links connect the elevator to the hook of the traveling block which hangs on a number of steel cables from the crown block in the top of the drilling rig. These links are used for linking drill pipe, casing, and tubing, and for lowering them into the hole. The elevator links bear the weight of the drill string as does the elevator swivel.

Traditionally, one-piece elevator links comprise a shank with an eye at each end of the shank manufactured as a single piece from alloy steel or other well known suitable materials. Links are commonly produced in set lengths. Links are also commonly designed and produced to be capable of supporting a given, set tonnage. The interchangeability and connectivity of links, elevators, and hooks are based on tonnage size classes. There is thus a need for elevator links of various lengths as well as for elevator links capable of supporting various tonnage loads. The length and tonnage required will, of course, vary with the drilling and equipment requirements of a particular job or undertaking.

Conventionally, links have been constructed as a unitary piece. Each pair of links are constructed to meet certain set tonnage requirements, such as being capable of supporting 500, 750, or 1000 tons. The links are also manufactured in certain given or set lengths such as 12 feet.

Consequently, certain lengths and tonnage capacities are often manufactured in greater abundance than other set lengths or tonnages. Depending on drilling demands in a particular drilling field, a shortage of certain lengths, tonnage capacities, or both may occur. At times a drilling site in a region may require links, for example, of twenty-one feet, while the primarily available links may be twelve feet in length.

Thus, it would be a benefit to have a method for construction and producing links of various length and tonnage capacities on relatively short notice.

GENERAL DESCRIPTION OF THE INVENTION

Pursuant to the foregoing, it may be regarded as an object of the present invention to overcome the deficiencies of and provide for improvements in the state of the prior art as described above and as may be known to those skilled in the art.

It is thus an object of the present invention to provide construction and producing links of various length and tonnage capacities on relatively short notice.

Still further objects may be recognized and become apparent upon consideration of the following specification, taken as a whole, in conjunction with the appended drawings and claims, wherein by way of illustration and example, an embodiment of the present invention is disclosed.

A multi-piece elevator link, which may be of variable length or capacity or both, is produced by cutting a unitary link into two or more parts and connecting different combinations of shanks and link ends to form the desired elevator link. Rotation of the link ends with respect to the shank may be prevented by a variety of means. For example, various threading, cross pins, locking mechanisms, interference fits, keys, hooks and the like may be employed. Various adapters may be employed between the shank and link ends to provide varying connections such as those produced by various threads, cross pins, ball-and-socket combinations, grooves and retaining rings, interference fits, keys, hooks and the like.

A method of dividing a unitary elevator link into two or more parts and providing the differing shank or link end or both is also set forth in the body of the specification, along with the use of the adapters and locking mechanisms.

To review the scope of the present invention, the variable length elevator link includes a shank, a first link end and a second link end.

The shank has a first collar end and a second collar end with each collar being adapted to connect to a link end. In one embodiment, each collar end may have internal threading to engage each second end of each link end having external threading.

Each link end has a first loop end forming an eye and a second end adapted for connecting to the first and second collar end of the shank. In one of the preferred embodiments, each link end has external threading to engage each shank collar having internal threading.

The method of the present invention allows one to select a shank of any desired length subject only to material strength limitations.

It has also been noted that when desired rotation may be prevented by means of the use of nuts and bolts or screws in the anti-rotation hole drilled through each shank collar engaged with a link end having corresponding holes drilled in its shank end.

There are many methods of connecting the components of the present invention. These techniques range from the easily assembled and disassembled to relatively permanent connections. Interference fits, ball-and-socket, grooves with lock or retaining rings, threads of single or multiple starts, and either straight or tapered pitch diameter, cross pins,jam or lock nuts, keys, and hooks are all alternative connections which may be employed in connection with the components of the present invention. Mechanisms such as nylon rings or inserts or both, anaerobic adhesives, or thread locking compounds may also be used.

It is to be noted that in one of the preferred embodiments a cross-drilled pin is located at or near the free end of the link connection where a hole is drilled through the male member at the end which is not stressed by the axial load. While the mating hole in the shank or adapter is therefore in the "high stress zone" of the shank or the adapter, these parts can be made of a sufficient cross-section or size so as to negate the effect on the part.

Some of the above alternatives may be used for direct connection of the link to the adaptor or to the center section shank, the limitation being the specific dimensions of the connecting means and the material available in the parts.

It is desirable to mate a threaded link end with one, and only one, threaded connection for its usable life, since no two threaded parts have the same characteristics, such as thread pitch. High loads on long, engaged lengths of such threads generally lead to some localized yielding. Changing mating parts would cause additional yielding, as two mating parts are deformed to match each other.

Each additional loading which is accompanied by yielding increases the chance of fatigue damage, which would render the part useless. In general, the connections made to the link ends are intended to be "married for life".

One of the advantages of using an adapter between the shank and the link end is that the adapter can be mated to the link end instead of the shank itself. In other words, the adapter can be threaded as required to mate with the link end "for life", with the connection at the opposite end of the adapter being designed and sized for interchanging shank center sections with each link end. For example, this approach could include different thread styles, larger connection size, or a different type of connection, all made possible by the fact that the adapter can be made as desired, and the interchangeable end of the adapter is not limited by the pre-existing size of the link. Once an adapter is fitted to the link ends, a center section can be fitted between the adapters of the opposing link ends.

By manufacturing different length shank center sections, one can produce an unlimited number of specific lengths.

Furthermore, the use of these adapters would allow interchangeable combinations, that is to say, assembling link ends of different nominal sizes or manufacturers or both into one assembly. It is sometimes the case that an elevator of 1000 ton capacity is selected for a string of only 500 tons, not because of the capacity of the elevator, but because of the slips which engage the pipe. Certain slips do less damage to the pipe being linked. However, the drilling rig may be equipped with only a 500 ton hook, which will not accept the larger 1000 ton links. In this case, the elevator links could be assembled with a 500 ton link end at the top in order to engage the hook, and a 1000 ton link end at the lower end in order to engage the elevator.

While one-piece forged links can be special ordered with different ends as described above, they are expensive and involve long delivery times. In general, such one-piece forged links can not be reconverted or reversed in orientation.

One set each of 500, 750, and 1000 ton links, equipped with adapters and a variety of combinations of center section shanks makes possible a large number of combinations and lengths.

Among the inventive features of the present invention are:

A first elevator link, having an elongated shank member comprising a connecting end and a first link end forming an aperture; and a second link having a first loop end forming an aperture and a second end adapted for connecting to the connecting end of the elongated shank member.

These features may also include a first link end which has a first loop end forming an aperture and a second end adapted for connecting to the shank and further means adapted for connecting such as internal threading in the connecting end of the elongated shank member; and external threading of the second end of the link end adapted for connecting to the connecting end of the elongated shank member.

Other means may also be adapted for connecting, such as a cross pin providing a connection between the connecting end of the elongated shank member and the link end.

A locking mechanism may be used in a connection between the elongated shank member and the link to prevent rotation of the link end in relation to the elongated shank member.

An adaptor with a first connecting end and a second connecting end; a link having a second end adapted for connecting being adapted to engage the first connecting end of the adapter; and the connecting end of the elongated shank member being adapted to engage the second connecting end of said adapter, also, is an inventive feature of the present invention, as are a ball-and-socket, grooves with retaining rings. threads of multiple start configurations. threads of tapered pitch diameter, cross pins, interference fits and means employing keys and hooks.

A further aspect of the present invention is the method of making a multi-piece elevator link, which may be of variable length or variable capacity or both, comprising in one way or another providing a unitary one piece elevator link comprising an elongated shank member, a first link end having a loop end forming an aperture, and a second link end having a loop end forming an aperture, said first and second link ends being at opposite ends of the elongated shank member, cutting the elongated shank member into two parts, providing at least one end of the elongated shank member with means adapted for connecting to an end link, and attaching a link end to the means adapted for connecting with the elongated shank member.

The means for connecting may be provided for both link ends, and an adapter may be placed between the elongated shank member and the link end and a means of connection may be provided for the elongated shank member and the link ends including means of connection through the adapter.

Rotation of the link ends with respect to the elongated shank member may be provided for. The end link and the adapter may be connected by means intended to mate them for their useful life. The connection to the elongated shank member allows for a change of the elongated shank member or the end link.

In short, multi-piece elevator links, which may be of variable length or capacity or both, may be produced by cutting a unitary link into two parts and connecting different combinations of shanks and link end to form the desired elevator link. Alternatively, the link ends may be manufactured with a loop end on one end and a connector on the other, the connector capable of connecting to the shank. This eliminates the need for a separate adapter by combining the adapter function with the link end.

Rotation of the link ends with respect to the shank may be prevented. Adapters may be employed between the shank and the link ends to provide varying connections.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 1 is a top and side view of a unitary elevator link, in which

FIG. 2 is a top and side view of a unitary elevator link after division in accordance with the present invention, in which

FIG. 6 shows a top view of four alternative forms of adaptors which may be employed in accordance with the present invention, in which

GENERAL DESCRIPTION AND EXEMPLARY MODE FOR CARRYING OUT THE INVENTION

For a further understanding of the nature, function, and objects of the present invention, reference should now be made to the following detailed description taken in conjunction with the accompanying drawings. Detailed descriptions of the preferred embodiments are provided herein, as well as, the best mode of carrying out and employing the present invention. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner. The practice of the present invention is illustrated by the following examples which are deemed illustrative of both the process taught by the present invention and of the product and article of manufacture yielded in accordance with the present invention.

Figure 1A:
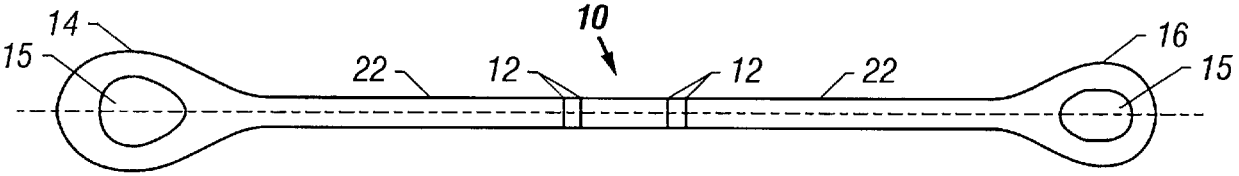
FIG. 1A is the top view and FIG. 1B is the side view.
Figure 1B:
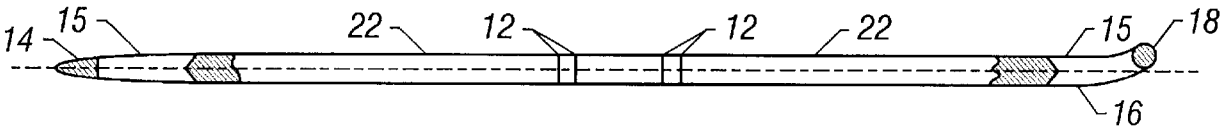
Figure 2A:
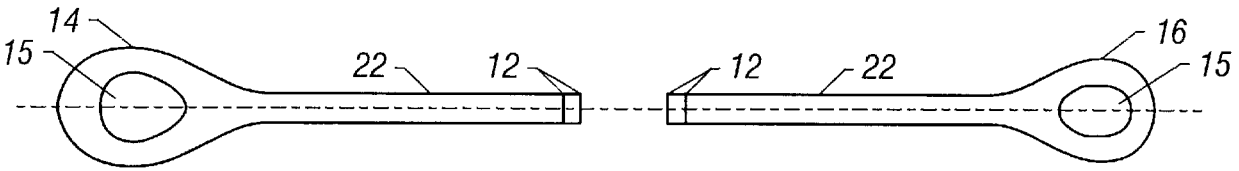
FIG. 2A is the top view and FIG. 2B is the side view.

In general, the present invention is implemented by beginning with a conventional unitary elevator link 10 as shown in FIGS. 1 and 2. The end eyes 15 are separated from a central shaft portion 22 and then recombined in various combinations as desired. The central shaft portion may, of course, be from a few inches in length to several feet long as may be desired.

Figure 2B:
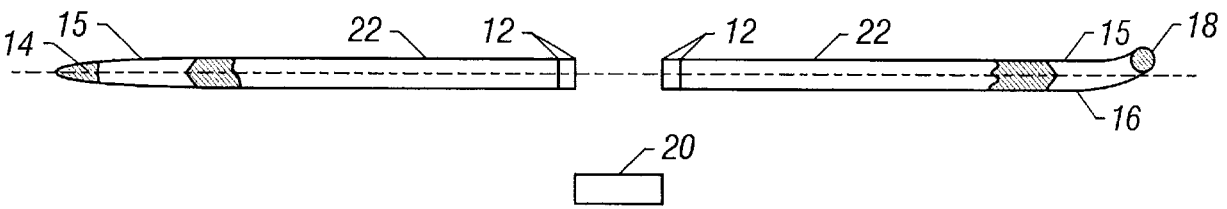

A preferred method of implementing the present invention is best illustrated by reference to the appended figures beginning with FIG. 1 and FIG. 2 which show a conventional unitary elevator link 10 produced by the method described in the background or any other well known or conventional method. The unitary elevator link 10 comprises a shank 22 and two ends generally referred to as the link ends 14 and 16. Shank 22 is the long, narrow stalk or stem portion of bar material between the two ends 14 and 16. As has been described in the background, the link ends 14 and 16 are conventionally manufactured with a void in each end. The voids or apertures are generally referred to as the eyes 15 by analogy with the eye of a needle although generally and in practice elevator links are many orders of magnitude larger than anything thought of as a conventional needle. The ends 14 and 16 of the elevator link 10 may differ slightly as a bottom end may have a slightly upturned end 18 as shown in FIGS. 1B and 2B. For purposes of the present invention the differences in the end 14 and 16, if any, are not a crucial feature but, of course, will be take into account by those skilled in the art as the situation and desired results may warrant. In a like fashion the eyes 15 may be manufactured in slightly different geometries depending on the intended use. While the eyes are in general cylindrical holes they may in practice be manufactured as ovals or ellipses with slightly flattened elongate sides or in slightly pear shaped configurations depending on the intended applications.

In practicing the method of the present invention, the shank 22 is scribed as indicated at the marks 12. The shank 22 is cut at the inner, most central inscriptions 12 and a tensile coupon or plug 20 is remove from the center section of the shank 22 as shown in FIG. 2B. The tensile coupon or plug 20 may be used for testing the tensile strength of the shank 22 or for other tests of mechanical properties on the material such as will be familiar to those skilled in the mechanical arts. The unitary elevator link 10 has now been formed into a first link end 14 and a second link end 16, with each link end 14 and 16 having an eye end forming the eyes 15 and a projecting shank portion or end of shank 22 material.

Figure 3:
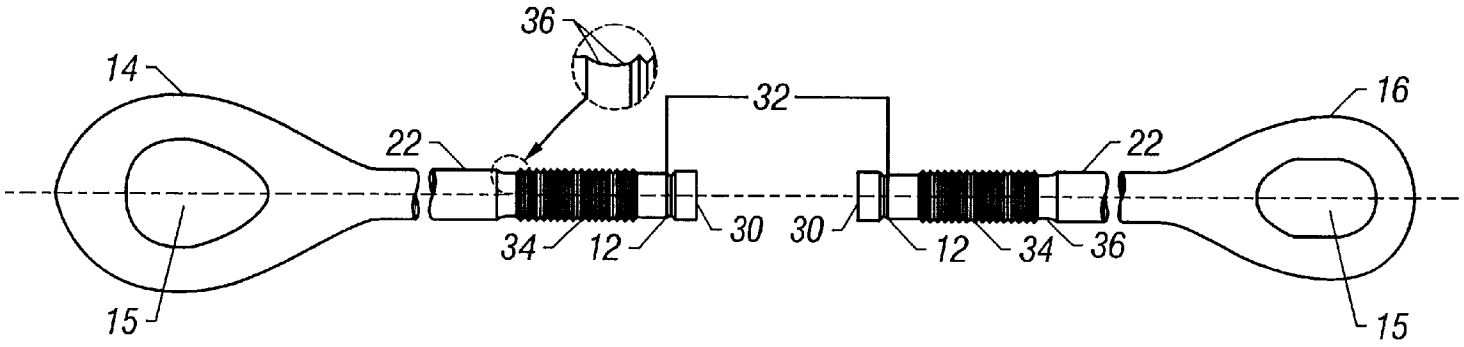
FIG. 3 is a top view of the two ends of the elevator link as threaded and machined.

Turning to FIG. 3 it will be seen that after severing the eyes 15 from the tensile coupon or plug 20 (see FIG. 2) the shank end may be threaded for attachment to one or another central shank member 22. The reference numeral 32 indicates the reference location of the scribe mark 12 for machining and threading operations. Excess stock blocks or cylinders 30 may be used for chuck mounting and then removed following machining of the end. The projecting shank end 22 of each link end 14 and 16 may be threaded externally by the addition of threads 34 thereto. In addition, a relief radius 36, sized appropriately to permit sealing or lubrication of the threads and typically a ¼ inch radius, may be circumscribed around the upper end of the threads 34 nearest the link ends 14 and 16, as desired, and gripping of the ends 14 and 16 by fishing or gripping tools and the like.

Figure 4:
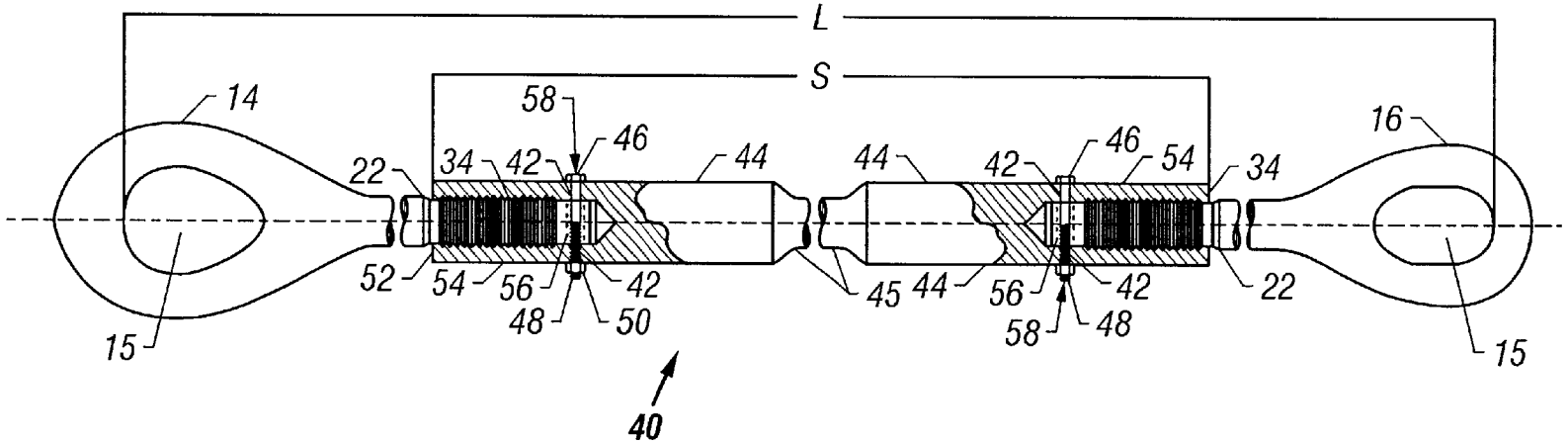
FIG. 4 is a top view of the two ends of the elevator link as inserted into a central shank.

FIG. 4 shows the simplest and a preferred mode of implementing the present invention as a multi-sectional elevator link 40. In this embodiment the shank ends 22 of the link ends 14, 16 are inserted directly into the central shank portion 44. The link ends 14 and 16 each forming an eye 15 have been machined along their shank end 22 to provide external threads 34 as shown and described in connection with FIG. 3. A shank 44 which may be of varying dimensions as suggested at 45, in which the shank bar 44 may be either narrowed in the region 45 or enlarged in the region 45. In any case the end collar regions 54 of shank 44 must be of sufficient diameter to accommodate the shank end 22 of link ends 14 and 16. A cavity is bored longitudinally along the center line axis of shank 44 of sufficient diameter and depth to accommodate the shank end 22 of elevator link ends 14 and 16. In addition the cavity is threaded with internal threads to engage threads 34 which are external to shank 22 which is threaded into the shank 44 to a depth to place the threads 34 slightly inside the collar ends 54 as shown at 52.

To prevent rotation of the link ends 14 and 16 within the collars 54, a rotational restraining device 58 is provided. The shaft of each shank end 22 has been bored with a transverse hole 56 along the center line and axis of shank end 22 and perpendicular thereto and so positioned as to lie in the plane of the link heads 14 and 16, respectively.

Matching and mating holes 42 are bored in the collar section 54 of shank 44 and a suitably sized bolt 46 is inserted through holes 42 and 56 to permit bolt 46 to pass through and be secured by nut 48, which may be further secured to the bolt 46 as indicated at 50 to prevent tampering such as by welding.

By selecting the desired length shank, of length S, the effective length of the elevator link, L, may be altered. By selecting various link ends 14 and 16 and various size shanks 44 the tonnage capacity may also be altered.

From these various combinations a multi sectional elevator link 40 may be fashioned of the desired length and of the desired tonnage capacity.

Figure 5:
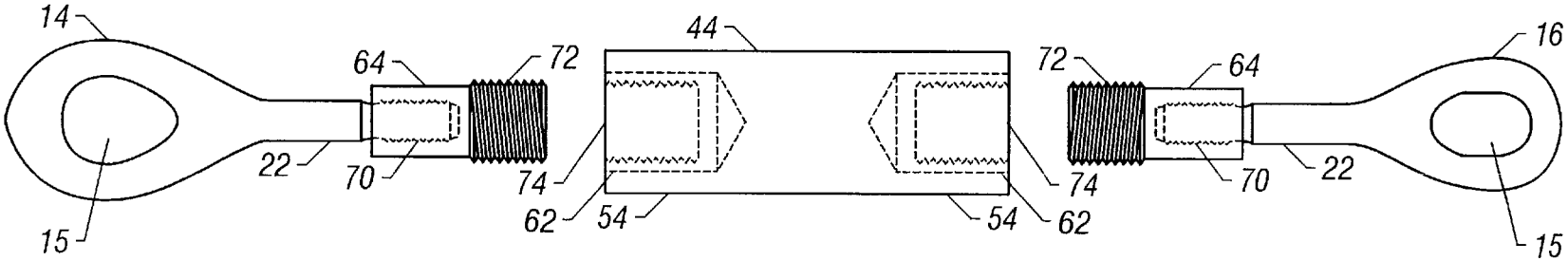
FIG. 5 is a top view of the two end of an elevator link inserted in an adaptor for insertion into a central shank.

As shown in FIG. 5, the above described approach to tailoring the length and tonnage capacity of elevator links may be taken a step further in the particularly preferred embodiment shown.

In the approach of FIG. 5 an adaptor 64 is employed. The adaptor 64 may be of several different forms as will be discussed in greater detail below with regard to FIG. 6. The elevator link ends 14 and 16 with eyes 15 and with projecting shank ends 22 are prepared and threaded as described above in connection with FIG. 3. However, instead of being inserted into shank 44 directly, the projecting shank 22 is inserted into an adaptor 64. The adaptor 64 makes possible the employment of a wide variety of varying size and types of threading and size and strength of shank 44.

Both standard and non-standard sizes and threads may be employed. In addition the use of an adaptor 64 may allow for additional degrees of freedom of motion for the link ends 14 and 16 as will be seen in particular with the embodiments of FIGS. 6A and 6D.

As shown most directly in FIG. 5 the link end 14 and 16 may be threaded into the adaptor 64 by insertion into an internally threaded cavity 70. Various combinations of standard and non-standard threads of varying pitch and dimension may be employed to produce locked or cross threads which effectively secure the link end 14 or 16 within the adaptor 64 for the life of the parts. The adaptor 64 may itself have external threads 72 on its other end for insertion into a cavity 74 in the collar portion 54 of the ends of shank 44. Internal threads 62 may be provided in the cavity 74 on one or both of the ends of shank 44.

Among the many alternative adaptors are those shown in FIG. 6.

Figure 6A:
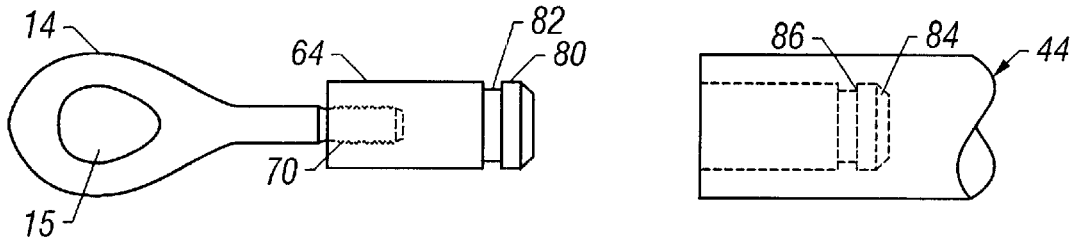
FIG. 6A represents a retaining ring adaptor.

FIG. 6A shows link end 14 with eye 15 threaded in cavity 70 of adaptor 64 being provided with groove 82 and tapered end 80. The tapered end 80 is inserted into cavity 84 in shank 44 and retained by the action of a retaining ring in groove 86.

Figure 6B:
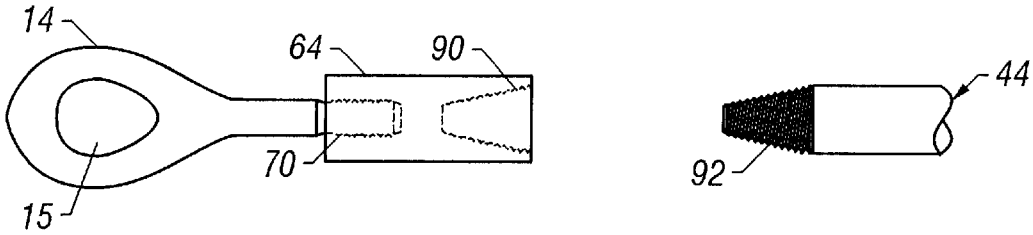
FIG. 6B represents a multiple start and tapered pitch adaptor.

FIG. 6B shows link end 14 with eye 15 threaded in cavity 70 of adaptor 64. Adaptor 64 may be provided with inclined or tapered multiple start threads 90 for mating with a tapered pitch threaded diameter 92 on the end of shank 44.

Figure 6C:
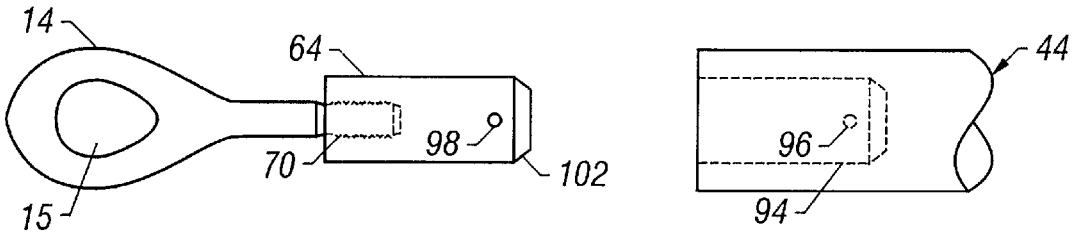
FIG. 6C represents across pin adaptor and FIG. 6D represents a ball-and-socket adaptor.

FIG. 6C shows link end 14 with eye 15 threaded in cavity 70 of adaptor 64. The adaptor 64 has a drilled hole 98 and tapered end 102 for insertion into a matching cavity 94 in shank 44 which has been drilled with matching holes 96. A nut and bolt combination as described above with reference to FIG. 4 may be used to prevent rotation as well as for fastening the link end in place, if desired.

Figure 6D:
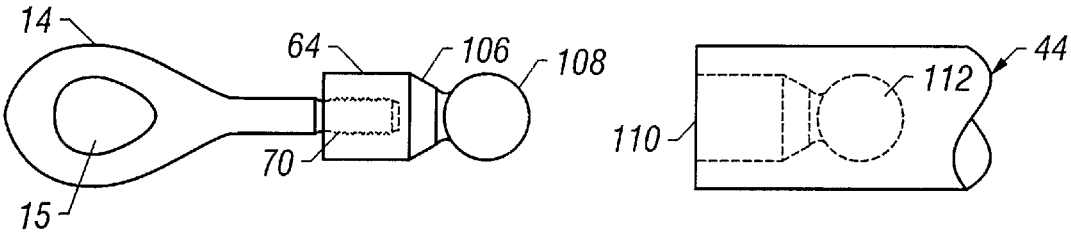

FIG. 6D shows link end 14 with eye 15 threaded into cavity 70 of adaptor 64. A tapered segment 106 of the adaptor connects to ball 108 which is inserted into a ball cavity or socket 112 through tapered section 110 in the end of shank 44.

It is to be noted that the link end 14 are provided with additional degrees of rotational freedom as shown in FIG. 6A and with a 360° cone of freedom of motion, as well as, with rotational freedom in the embodiment of FIG. 6D. The other embodiments provide a constraint on the freedom of motion for situations in which it is desired.

To review the scope of the present invention, the variable length elevator link includes a shank, a first link end and a second link end.

The shank has a first collar end and a second collar end with each collar being adapted to connect to a link end. In one embodiment each collar end may have internal threading to engage each second end of each link end having external threading.

Each link end has a first loop end forming an eye and a second end adapted for connecting to the first and second collar end of the shank. In one of the preferred embodiments each link end has external threading to engage each shank collar having internal threading.

It is to be noted that in one of the preferred embodiments a cross-drilled pin is located at or near the free end of the link connection where a hole is drilled through the male member at the end which is not stressed by the axial load. While the mating hole in the shank or adapter is therefore in the "high stress zone" of the shank or the adapter, these parts can be made sufficient cross-section or size so as to negate the effect on the part.

As taught by the specific examples discussed above there are many methods of connecting the components of the present invention. These techniques may range from the easily assembled and disassembled to relatively permanent connections. Interference fits, ball-and-socket, grooves with lock or retaining rings, threads of single or multiple start and either straight or tapered pitch diameter, cross pins, jam or lock nuts, keys, and hooks are all alternative connections which may be employed in connection with the components of the present invention. Additional mechanisms may be present to further secure the connections such as nylon rings or inserts or both, anaerobic adhesives, or thread locking compounds.

Some of the above alternatives may be used for direct connection of the link to the adaptor or to the center section shank, the limitation being the specific dimensions of the connecting means and the material available in the parts.

It is desirable to mate a threaded link end with one, and only one, threaded connection for its usable life, since no two threaded parts have the same characteristics, such as thread pitch. High loads on long, engaged lengths of such threads generally lead to some localized yielding. Changing mating parts would cause additional yielding, as two mating parts are deformed to match each other. Each additional loading which is accompanied by yielding increases the chance of fatigue damage, which would render the part useless. In general, the connections made to the link ends are intended to be "married for life".

One of the advantages of using an adapter between the shank and the link end is that the adapter can be mated to the link end instead of the shank itself. In other words, the adapter can be threaded as required to mate with the link end "for life", with the connection at the opposite end of the adapter being designed and sized for interchanging shank center sections with each link end. For example, this approach could include different thread styles, larger connection size, or a different type of connection, all made possible by the fact that the adapter can be made as desired, and the interchangeable end of the adapter is not limited by the pre-existing size of the link. Once an adapter is fitted to the link ends, a center section can be fitted between the adapters of the opposing link ends. By manufacturing different length shank center sections, one can produce an unlimited number of specific lengths.

Furthermore, the use of these adapters would allow interchangeable combinations, that is to say, assembling link ends of different nominal sizes or manufacturers or both into one assembly. It is sometimes the case that an elevator of 1000 ton capacity is selected for a string of only 500 tons, not because of the capacity of the elevator, but because of the slips which engage the pipe. Certain slips do less damage to the pipe being lifted. However, the drilling rig may be equipped with only a 500 ton hook, which will not accept the larger 1000 ton links. In this case, the elevator links could be assembled with a 500 ton link end at the top in order to engage the hook, and a 1000 ton link end at the lower end in order to engage the elevator.

While one-piece forged links can be special ordered with different ends as described above, they are expensive and involve long delivery times. In general, such one-piece forged links can not be reconverted or reversed in orientation.

Figure 7:
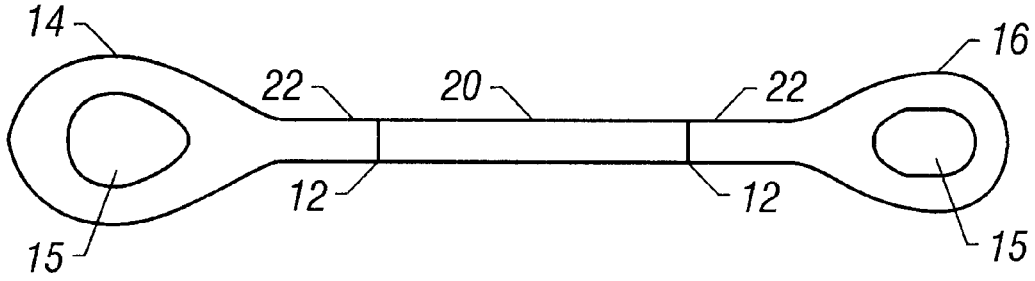
FIG. 7 is a top view of a unitary elevator link.
Figure 8:
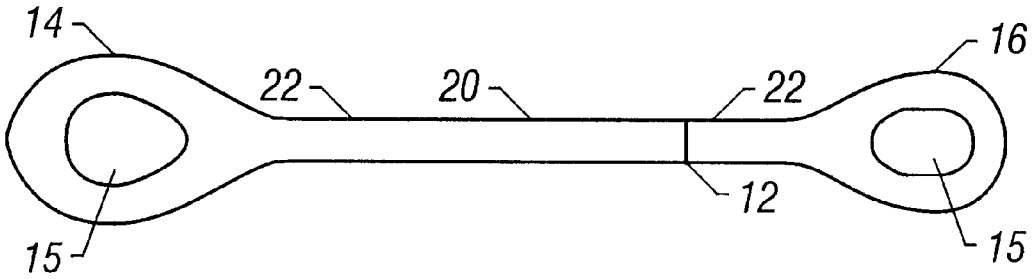
FIG. 8 is a top view of a unitary elevator link.

In the operation of the preferred embodiment, the process of creating the present invention may begin in one of a number of ways. For example, a single unitary forged unit may be severed in two places to yield two ends 22 and a central plug portion 20 as shown in FIG. 7. These component parts may be joined with other similarly severed components to produce a link having the desired length and load capacity, Another approach which may be employed independently or in combination with the above process is to sever a single unitary forged unit at a single point as shown in FIG. 8 in which one eye 15 and central plug 20 remain as a single unit and a separated eye 15 and shank 22 unit is produced to be employed in other combinations with other length shanks or other rated load units.

Figure 9:
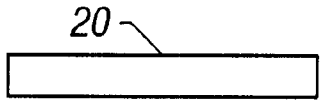
FIG. 9 is a top view of a central shank.
Figure 10:
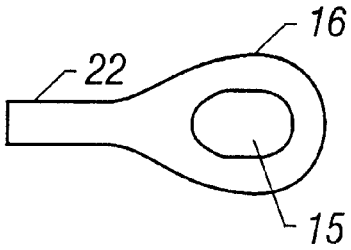
FIG. 10 is a top view of an end link.

Finally as shown in FIGS. 9 and 10 individual central shanks 22, central plugs 20, and individual eyes 15 may be produced to be employed in any number of possible desired combinations.

One set each of 500, 750, and 1000 ton links, equipped with adapters and a variety of combinations of center section shanks makes possible a large number of combinations and lengths.

As has been described herein these various combinations and the ability to produce variable length and capacity links is a result of the application of the inventive concepts of the present invention. For example, a variable length or strength multi-piece elevator link 10 may be produced by providing an elongated shank 22 and a link end having a loop end forming an aperture and eye member at one end of the elongated shank member and then providing a link end forming an aperture and eye member for attachment to the opposite end of the elongated central shank member to produce an elevator link of the desired length or load capacity or both by attaching at least one link end having a loop end forming an aperture and eye member to said central shank At least one of the link ends having a loop end forming an aperture and eye member may be attached to the elongated central shank member by means of an adaptor. Of course it is possible depending upon the desired end for one of the link ends forming an aperture and eye member to be and remain a unitary part of the elongated central shank member. The cutting each of several unitary one piece elevator links into at least two parts to form two or more link ends each having a different capacity from the other and two or more elongated central shank members each being of a different length or capacity from another elongated central shank member formed and produced in the same manner as defined herein; followed by attaching at least one of the link ends to one of the elongated central shank members provides a means and a method permitting the formation of a wide variety of variable length and/or capacity elevator links within or without the use of an adaptor between the link ends and the elongated central shank member.

The adaptor may provide means to lengthen or shorten the effective length of the total elevator link and/or to permit rotation of the link end with its loop end forming an aperture and eye member around the central longitudinal axis of the elongated central shank member. The adaptor may include locking means which restrict or prevent rotation of the link end around the central longitudinal axis of the elongated central shank member. Additionally, the link ends may be manufactured integrally with the adapter in a single forging when the invention is applied during the initial manufacture.

It is noted that the embodiment of the elevator link described herein in detail for exemplary purposes is, of course, subject to many different variations in structure, design, application and methodology. Because many varying and different embodiments may be made within the scope of the inventive concepts herein taught, and because many modifications may be made in the embodiment herein detailed in accordance with the descriptive requirements of the law, it is to be understood that the details herein are to be interpreted as illustrative and not in a limiting sense. It will be understood in view of the instant disclosure, that numerous variations on the invention are now enabled to those skilled in the art. Many of the variations reside within the scope of the present teachings. It is not intended to limit the scope of the invention to the particular forms set forth, but on the contrary it is intended to cover such alternatives, modifications, and equivalents as may be included within the spirit and scope of the teachings of the present invention. Accordingly, the invention is to be broadly construed and is to be limited only by the spirit and scope of the claims appended hereto.

What is claimed is:

1. An elevator link, comprising:

an elongated shank member comprising a first connecting end and a first link end having an aperture therethrough, the first link end capable of supporting a first predetermined tonnage; and a second link having a second connecting end and a first loop end having an aperture therethrough, the second link capable of supporting a second predetermined tonnage;

wherein the second connecting end of the second link is adapted to connect to the first connecting end of the elongated shank member; and the first predetermined tonnage is different than the second predetermined tonnage.

2. The elevator link of claim 1 wherein the first connecting end of the elongated shank member and the second end of the second link further comprise a set of complementary threads whereby the set of complementary threads matingly engage the elongated shank member to the second link.

3. The elevator link of claim 1 further comprising at least one cross pin in connection between the first connecting end of the elongated shank member and the second connecting end of the second link.

4. The elevator link of claim 1 further comprising a locking mechanism disposed intermediate the elongated shank member and the second link to prevent rotation of the second connecting end of the second link in relation to the elongated shank member.

5. The elevator link of claim 1 further comprising an adapter, the adapter comprising a first connecting end and a second connecting end wherein the second connecting end of the second link is adapted to engage the first connecting end of the adapter and the first connecting end of the elongated shank member is adapted to engage the second connecting end of the adapter.

6. The elevator link of claim 5 wherein the adapter and the second link comprise a single forged unit.

7. The elevator link of claim 5 wherein the first connecting end of the adapter and the second connecting end of the second link comprise a ball-and-socket.

8. The elevator link of claim 5 wherein the second connecting end of the adapter and the first connecting end of the elongated shank member comprise a ball-and-socket.

9. The elevator link of claim 5 wherein the first connecting end of the adapter and the second connecting end of the second link comprise at least one groove and at least one retaining ring.

10. The elevator link of claim 5 wherein the second connecting end of the adapter and the first connecting end of the elongated shank member comprise at least one groove and at least one retaining ring.

11. The elevator link of claim 5 wherein the first connecting end of the adapter and the second connecting end of the second link comprise threads of multiple start configurations.

12. The elevator link of claim 5 wherein the second connecting end of the adapter and the first connecting end of the elongated shank member comprise threads of multiple start configurations.

13. The elevator link of claim 5 wherein the first connecting end of the adapter and the second connecting end of the second link comprise threads of tapered pitch diameter.

14. The elevator link of claim 5 wherein the second connecting end of the adapter and the first connecting end of the elongated shank member comprise threads of tapered pitch diameter.

15. The elevator link of claim 5 wherein the first connecting end of the adapter and the second connecting end of the second link comprise at least one cross pin.

16. The elevator link of claim 5 wherein the second connecting end of the adapter and the first connecting end of the elongated shank member comprise at least one cross pin.

17. The elevator link of claim 5 wherein the first connecting end of the adapter and the second connecting end of the second link comprise interference fits.

18. The elevator link of claim 5 wherein the second connecting end of the adapter and the first connecting end of the elongated shank member comprise interference fits.

19. The elevator link of claim 5 wherein the first connecting end of the adapter and the second connecting end of the second link comprise at least one key.

20. The elevator link of claim 5 wherein the second connecting end of the adapter and the first connecting end of the elongated shank member comprise at least one key.

21. The elevator link of claim 5 wherein the first connecting end of the adapter and the second connecting end of the second link comprise at least one hook.

22. The elevator link of claim 5 wherein the second connecting end of the adapter and the first connecting end of the elongated shank member comprise at least one hook.

* * * * *